United States Patent [19]

Kutsukake et al.

[11] Patent Number: 4,559,273

[45] Date of Patent: Dec. 17, 1985

[54] HEAT TRANSFER SHEET

[75] Inventors: Masaki Kutsukake, Tokyo; Mineo Yamauchi, Ichikawa; Masanori Akada, Tokyo, all of Japan

[73] Assignee: Dai Nippon Insatsu Kabushiki Kaisha, Japan

[21] Appl. No.: 706,757

[22] Filed: Feb. 28, 1985

[30] Foreign Application Priority Data

Mar. 2, 1984 [JP] Japan ..... 59-39884
Oct. 18, 1984 [JP] Japan ..... 59-219183

[51] Int. Cl.[4] ..... B41M 5/26

[52] U.S. Cl. ..... 428/484; 8/471; 428/207; 428/423.1; 428/423.7; 428/480; 428/488.4; 428/913; 428/914

[58] Field of Search ..... 8/470, 471; 346/200, 346/226; 428/204, 207, 323, 327-331, 423.1, 423.7, 480, 483, 484, 488.1, 488.4, 500, 913, 914

[56] References Cited

FOREIGN PATENT DOCUMENTS 2060920A 5/1981 United Kingdom ..... 346/200

*Primary Examiner*—Bruce H. Hess
*Attorney, Agent, or Firm*—Parkhurst & Oliff

[57] ABSTRACT

This invention relates to a novel heat transfer sheet. By providing a heat-resistant protective layer comprising specific ingredients on a first surface of a base sheet having a heat transfer layer on a second surface thereof, there is obtained a heat transfer sheet wherein the running of a thermal head is smooth during recording; wherein an image having a high density and exhibiting no surface roughness at printing areas can be provided; wherein when the heat transfer sheet is wound up and stored, a dye does not migrate to the heat-resistant protective layer; and wherein the adhesion between the heat transfer sheet and a roll or the like does not occur within travelling apparatus.

10 Claims, 1 Drawing Figure

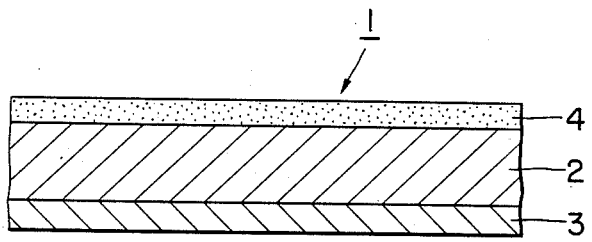
1
4
2
3

HEAT TRANSFER SHEET

BACKGROUND OF THE INVENTION

This invention relates to a heat transfer sheet, and more particularly to a heat transfer sheet suitable for carrying out heat printing in accordance with image information by heating means such as thermal heads in order to form an image onto a heat transferable sheet or a sheet to be heat transferred. More specifically, this invention relates to a heat transfer sheet provided with a heat-resistant protective layer capable of preventing the fusion bonding between the heat transfer sheet and thermal heads in printing or running the thermal heads.

Heretofore, a heat sensitive color-producing paper has been primarily used in order to obtain an image in accordance with image information by means of thermal heads. In this heat sensitive color-producing paper, a colorless or pale-colored leuco dye (at room temperature) and a developer (such as bisphenol A) provided on a base paper are contacted and reacted by the application of heat to obtain a developed color image.

However, the heat sensitive color-producing paper as described above has serious drawbacks in that its color disappears and non-image areas form color when the resulting image is stored for a long period of time. Further, color printing is restricted to two colors, and thus it is impossible to obtain a color image having a continuous gradation.

On the other hand, products which have been recently used in order to overcome the drawbacks as described above are a heat sensitive fusing transfer sheet wherein a heat-fusing wax layer having a pigment or dye dispersed therein is provided on a sheet-shaped base; and a heat sensitive sublimation transfer sheet wherein a heat sensitive sublimation transfer layer comprising a dye having heat transferability and a binder therefor is provided on a sheet-shaped substrate.

When this heat sensitive fusing transfer sheet is laminated with a heat transferable sheet and then heat printing is carried out from the back of the heat sensitive fusing transfer sheet, the heat fusing wax layer containing the pigment or dye is transferred onto the heat transferable sheet to obtain an image. According to this printing process, an image having higher durability than that of the heat sensitive color-producing sheet can be obtained, and a multi-color image can be obtained by using a heat sensitive transfer sheet containing three primary color pigments or dyes and printing it many times.

On the other hand, in the heat sensitive sublimation transfer sheet, the binder layer containing the dye having heat transferability is provided on the sheet-shaped base or substrate. When this heat sensitive sublimation transfer sheet is laminated with a heat transferable sheet and then heat printing is carried out from the back of the heat sensitive sublimation transfer sheet, only dye present in the binder layer is heat sublimated and transferred on the heat transferable sheet to obtain an image. In this printing process, a multi-color image can be also obtained by using a heat sensitive sublimation transfer sheet containing three primary color dyes having heat transferability and printing it many times.

In recent years, there has been a growing demand for a method and means for obtaining an image having a continuous gradation like a color photograph directly from an electrical signal, and a variety of attempts have been made to meet this demand.

One of such attemps is a process for directly obtaining a silver salt color photograph from a cathode-ray tube (CRT) picture. However, this process is accompanied by the following drawbacks. The running cost is high. When silver salt film is a 35 mm film, the image cannot be instantly obtained because it is necessary to carry out a development treatment after the photographing.

An impact ribbon process and an ink jet process have been proposed as further processes. However, in these processes, the quality of the image is inferior and an image treatment is required. Thus, it is impossible to simply obtain an image like a photograph.

In order to overcome such drawbacks, an attempt has been made to carry out the recording by using the heat sensitive sublimation transfer sheet described above. In this process comprising using this heat sensitive sublimation transfer sheet, the dye having heat transferability present in the heat sensitive sublimation transfer layer is transferred onto the transferable sheet according to the amount of heat energy applied to the heat sensitive sublimation transfer sheet. Accordingly, an image having a continuous gradation can be obtained and recording can be carried out from a television signal by a simple treatment.

Examples of the bases of the heat transfer sheet heretofore used are condenser papers, polyester films, polypropylene films, cellophane and cellulose acetate films. The thickness of the base used is of the order of 10 microns.

Of these bases, if cost is regarded as being important, condenser paper has been used. If resistance to rupture during application processing, operating simplicity in a printer, uniform thickness and smooth surface are regarded as being important, plastic films have been used. Of plastic films, if the strength in the case of tissue paper is regarded as being important, a polyester film has been particularly preferably used.

A heat sensitive sublimation transfer layer comprising a heat sublimable dye and a binder therefor can be provided on such a polyester film, and heat printing can be carried out from the film surface provided with no heat sensitive sublimation transfer layer by means of a thermal head. However, when energy required for obtaining an image having a sufficient printing density is applied to the back surface of the film, the base sheet per se may fuse with the thermal head. Thus, so-called sticking phenomenon is observed and in some cases it is impossible to run the heat transfer sheet. In certain cases, the sheet may be broken from the fused portions.

In order to overcome these problems, several attempts have been proposed to provide the back surface of the base sheet of a heat sensitive fusing transfer sheet with a heat-resistant protective layer. Examples of such heat sensitive fusing transfer sheets are those wherein the back surface of a base is provided with a metallic layer or a silicone oxide layer as a wear-resistant layer (Japanese Patent Laid-Open Pub. No 143152/1979, and Japanese Patent Laid-Open Pub. No. 74195/1982), with a layer of heat-resistant resins such as silicone and epoxy resins (Japanese Patent Laid-Open Pub. No. 7467/1982), with a resin layer containing a surfactant which is solid or semisolid at room temperature (Japanese Patent Laid-Open Pub. No. 12978/1982), and with a pigment comprising a lubricating inorganic pigment and a heat-resistant resin therefor (Japanese Patent Laid-Open Pub. No. 155794/1981).

When the heat-resistant protective layer proposed in these Japanese Patent Laid-Open Publications is provided on the back surface of the heat sensitive sublimation transfer sheet to a film thickness of about 3 microns and then printing is carried out by means of a thermal head, in all cases, the sticking phenomenon is observed. Thus, the heat-resistant protective layers proposed cannot function as the protective layer.

This is because the heat-resistant protective layer of the heat sensitive sublimation transfer sheet described above undergoes high energy in printing. When heat energy required for heat sensitive fusing transfer recording is compared with heat energy for obtaining a sufficient recording density in a heat sensitive sublimation recording process wherein a sublimable dye is used, energy required for heat sensitive sublimation recording is at least about 1.5 times that required for heat sensitive fusing recording.

In order to overcome these problems, we have further carried out studies to find heat-resistant resins capable of using in the heat sensitive sublimation transfer sheet and to find systems wherein a lubricating material is incorporated in the resin described above. We have found the following facts.

In order to produce a heat sensitive sublimation transfer sheet provided with a heat-resistant protective layer by inexpensive processes such as coating rather than expensive processes such as vacuum deposition, it is necessary to use a resin having heat resistance as a base. In order to prevent the reduction of the heat sensitivity of a polyester film having a thickness of from about 6 to 10 microns, it is preferable that the heat-resistant protective layer has a thickness of from about 0.5 to 3 microns. In order to make it possible to carry out printing and running in the case of the heat transfer sheet provided with the heat-resistant protective layer having the thickness ranges described above, it is necessary to add any lubricating material to the resin base described above. When known inorganic materials such as talc and mica are added to the resin base as the lubricating material in a large amount to form a heat-resistant protective layer, running is not smooth and the solid areas become rough. Further, such inorganic materials may adhere to the thermal head.

In view of these findings, we have carried out further studies. As a result, we have now found that the use of a heat transfer sheet provided with a heat-resistant protective layer comprising specific components affords a heat transfer sheet capable of providing an image having a high density wherein the running of the thermal head is smooth during recording and the printing areas are not rough. The present invention has been developed on the basis of this discovery.

SUMMARY OF THE INVENTION

The present invention has been developed to achieve the following objects.

(a) One object is to provide a heat transfer sheet capable of running a thermal head without any sticking phenomenon even if it is heated to a considerably higher temperature than that of the case of a heat sensitive fusing transfer sheet by means of a thermal head.

(b) Another object is to provide a heat transfer sheet wherein surface roughness does not occur at the printing areas.

(c) A further object is to provide a heat transfer sheet wherein the materials present in a heat-resistant protective layer do not adhere to a thermal head even if heat printing is continuously carried out by the thermal head.

In order to achieve the above objects, according to the present invention, there is provided a heat transfer sheet comprising a heat transfer layer provided on one surface of a base sheet or substrate, and a heat-resistant protective layer provided on the other surface of said base sheet, i.e., the surface provided with no heat transfer layer, said heat-resistant protective layer containing (a) polyvinyl butyral, (b) an isocyanate such as diisocyanate and triisocyanate, and (c) a compound selected from the group consisting of phosphoric esters, its alkali metal and alkaline earth metal salts, and mixtures thereof.

A heat transfer sheet according to the present invention may have a heat melting wax layer comprising a dye or pigment and a wax material therefor as the heat transfer layer. A heat transfer sheet according to the present invention may have a binder layer containing a dye having heat transferability as the heat transfer layer. It is particularly preferable that a heat transfer sheet according to the present invention has a binder layer containing a dye having heat transferability.

BRIEF DESCRIPTION OF THE DRAWING

In the accompanying drawing:

FIGURE is a sectional view of a heat transfer sheet according to the present invention.

DETAILED DESCRIPTION OF THE INVENTION

A preferred embodiment of the present invention shown in the drawing will now be described.

As shown in FIGURE, a heat transfer sheet 1 according to the present invention comprises a heat transfer layer 3 provided on one surface of a base sheet 2, and a heat-resistant protective layer 4 provided on a surface having no heat transfer layer.

Films such as polyester film, polystyrene film, polysulfone film, polyvinyl alcohol film and cellophane can be used as the base sheet. Polyester film is particularly preferred from the standpoint of heat resistance. The thickness of the base sheet is from 3 to 50 micrometers, preferably from 3 to 10 micrometers.

The heat transfer layer 3 may be a heat sensitive sublimation transfer layer comprising a sublimable dye and a binder resin therefor. The heat transfer layer 3 may be also a heat sensitive fusing transfer layer comprising a dye or pigment and a wax material therefor.

In the heat sensitive sublimation transfer layer 3, the sublimable dye is contained in the binder resin. The thickness of this layer is from about 0.2 to about 5.0 micrometers, preferably from about 0.4 to 2.0 micrometers.

The dye incorporated in the sublimation transfer layer 3 is desirably a disperse dye. This dye desirably has a molecular weight of from about 150 to about 400. The dye can be selected by considering heat sublimation temperature, hue, weatherability, stability in binder-resin, and other factors. Examples of such dyes are as follows: Miketon Polyester Yellow-YL (C.I. Disperse Yellow-42, manufactured by Mitsui Toatsu, Japan), Kayaset Yellow-G (C.I. Disperse Yellow 77, manufactured by Nippon Kayaku, Japan), PTY-52 (C.I. Solvent Yellow 14-1; manufactured by Mitsubishi Kasei, Japan), Miketon Polyester Red BSF (C.I. Disperse Red 111, manufactured by Mitsui Toatsu, Japan), Kayaset Red B (C.I. Disperse Red B, manufactured by Nippon Kayaku, Japan), PTR-54 (C.I. Disperse Red 50, manufactured by Mitsubishi Kasei, Japan), Miketon Polyester Blue FBL (C.I. Disperse blue 56, manufactured by Mitsui Toatsu, Japan), PTB-67 (C.I. Disperse Blue 241, manufactured by Mitsubishi Kasei, Japan), Kayaset Blue 906 (C.I. Solvent 112, manufactured by Nippon Kayaku, Japan).

While the amount of the dye can vary depending upon the sublimation temperature of the dye, the degree of covering power in a developed color state, the dye is usually present in the heat transfer layer in an amount of about 5% to 70% by weight, preferably from about 10% to 60% by weight.

Binder resins are those which ordinarily have high heat resistance and do not prevent the transfer of the dye during heating. For example, the following binders can be used.

(1) Cellulose resins such as ethyl cellulose, hydroxyethyl cellulose, ethylhydroxy cellulose, hydroxypropyl cellulose, methyl cellulose, cellulose acetate, and cellulose acetate butyrate.

(2) Vinyl resins such as polyvinyl alcohol, polyvinyl acetate, polyvinyl butyral, polyvinyl pyrrolidone, polyester, and polyacrylamide.

In order to provide such a heat transfer layer 3 on the base sheet 2, the dye and the binder resin may be dissolved in a solvent or only dye may be dispersed therein to prepare an ink composition for forming a sublimation transfer layer. This ink composition may be provided on the base sheet 2 by suitable printing processes or application processes. Optional additives may be admixed in the ink composition for forming sublimation transfer layer as needed.

On the other hand, examples of binders for the heat sensitive fusing transfer layer 3 are carnauba wax, paraffin wax, acid wax and suitable synthetic binders. A dye or pigment is used as a colorant. The colorant is usually added in an amount of from 5% to 30% by weight of the binder.

The heat-resistant protective layer 4 is a layer mainly comprising (a) polyvinyl butyral, (b) an isocyanate and (c) a compound selected from the group consisting of phosphoric esters, its alkali metal and alkaline earth metal salts, and mixtures thereof. Polyvinyl butyral reacts with an isocyanate to form a resin having good heat resistance. Preferred polyvinyl butyral resins are those having a molecular weight as high as possible and containing a large amount of an —OH group which is a reaction site with the isocyanate. Particularly preferred polyvinyl butyral resins are those having a molecular weight of from 60,000 to 200,000, a glass transition temperature of from 60° C. to 110° C. and a vinyl alcohol content of from 15% to 40% by weight.

Specific examples of isocyanate compounds such as diisocyanates and triisocyanates used in forming the heat-resistant protective layer are paraphenylenediisocyanate, 1-chloro-2,4-phenylenediisocyanate, 2-chloro-1,4-phenylenediisocyanate, tolylene-2,4-diisocyanate, tolylene-2,6-diisocyanate, hexamethylene diisocyanate, 4,4'-biphenylene diisocyanate, triphenylmethane triisocyanate, and 4,4',4''-trimethyl-3,3',2'-triisocyanate-2,4,6-triphenylene isocyanurate.

Diisocyanate or triisocyanate is usually used in an amount of from about 1% to 100% by weight, preferably from about 5% to 60% by weight of polyvinyl butyral.

Phosphoric esters and its alkali metal and alkaline earth metal salts are used as a lubricant in the present invention. The phosphoric esters used as the lubricant are not in a salt form of alkali metal and alkaline earth metal salts of phosphoric esters described hereinafter. Specific examples of such phosphoric esters for use herein are Plysurf A 208 S available from Daiichi Kogyo Seiyaku, Japan, and GAFAC RS 710 available from Tohho Kagaku, Japan. Such phosphoric esters are used in an amount of from 1% to 60% by weight, preferably from 5% to 30% by weight of polyvinyl butyral. Because the phosphoric ester is added as the lubricant in such a state that the phosphoric ester is molecularly dissolved in a binder, the surface roughness of printing areas does not occur whereas solid lubricants such as mica and talc occur such a surface roughness. In travelling the heat transfer sheet within the printing travel apparatus and the like, the travel problem of the heat transfer sheet may occur by virtue of tension applied to this sheet or the printing pressure of a thermal head. In this case, the phosphoric ester is used alone, or used in combination with its metal salt described hereinafter.

An example of an alkali metal or alkaline earth metal salt of the phosphoric acid for use herein is GAFAC RD 720 available from Tohho Kagaku, Japan. This alkali metal or alkaline earth metal salt of the phosphoric ester is used in an amount of from 1% to 50% by weight, preferably from 10% to 40% by weight of polyvinyl butyral. Because the alkali metal or alkaline earth metal salt of the phosphoric ester is added as the lubricant in such a state that it is molecularly dissolved in a binder, the surface roughness of printing area does not occur whereas solid lubricants such as mica and talc occur such a surface roughness.

Particularly preferred salts of the phosphoric acid esters are sodium salts of phosphoric esters. Examples of such salts are represented by the following general formulae:

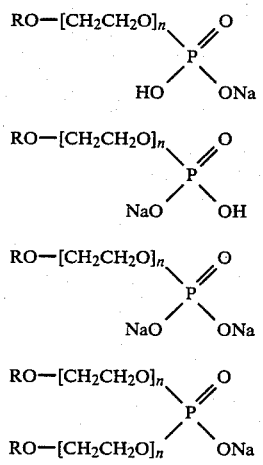

wherein R is an alkyl or alkylphenyl group containing from 8 to 30 carbon atoms and n is an average addition mole number of ethylene oxide.

When the alkali metal or alkaline earth metal salt of phosphoric ester is compared with the corresponding phosphoric ester (not salt), the former exhibits a pH of from 5 to 7 in water and the latter exhibits a pH of no more than 2.5. As can be seen from the foregoing, the alkali metal or alkaline earth metal salt of phosphoric ester exhibits a less acidity than the corresponding phosphoric acid. As described hereinbefore, polyvinyl butyral reacts with isocyanate to form a base of a heat-resistant protective layer. At strongly acidic regions, this reaction does not readily proceed. Further, the reaction consumes time and tends to reduce the degree of crosslinking per se. Accordingly, when the phosphoric ester (not salt form) is added to the reaction system of polyvinyl butyral/isocyanate, the reaction of both reactants requires a significantly long period of time, and the crosslinking degree of the resulting reaction product tends to be low. On the contrary, when the alkali metal or alkaline earth metal salt of phosphoric ester is added to the reaction system of polyvinyl butyral/isocyanates, the reaction of both reactants rapidly proceeds and the reaction product having a high degree of crosslinking is obtained. Accordingly, it is believed that, when a heat transfer sheet having a heat-resistant protective layer obtained by adding the alkali metal or alkaline earth metal salt of phosphoric ester to the reaction system of polyvinyl butyral/isocyanate is wound up and stored, the dye present in the heat transfer layer does not migrate to the heat-resistant protective layer.

When the alkali metal or alkaline earth metal salt of phosphoric ester is used as a lubricating agent in the heat-resistant protective layer, the alkali metal or alkaline earth metal salt of phosphoric ester does not migrate to the heat transfer layer even if the heat transfer layer comes in contact with the heat-resistant protective layer. Thus, the contamination of the heat transfer layer is not observed.

A filler can be incorporated in this heat-resistant protective layer as needed. Examples of such fillers for use herein are inorganic fillers such as clays, talc, zeolites, aluminosilicates, calcium carbonate, Teflon powder, zinc oxide, titanium dioxide, magnesium oxide, silica and carbon; and organic fillers having heat resistance such as the condensate of benzoguanamine and formaldehyde.

The average particle diameter of this filler is no more than 3 micrometers, desirably from 0.1 to 2 micrometers. The filler is used in an amount of from 0.1% to 25% by weight, preferably from 1.0% to 10% by weight of polyvinyl butyral.

The fusion bonding between the thermal head and the heat transfer sheet is reduced by incorporating such fillers in the heat-resistant protective layer. Thus, so-called sticking phenomenon is not completely observed. In addition, silicone oil can also be present in an amount of about 1% of polyvinyl butyral.

The heat-resistant protective layer 4 can be provided on the base sheet 2 by the following process. The ingredients described above are dissolved in a suitable solvent to prepare an ink composition for forming the heat-resistant protective layer. The ink composition is applied onto the base sheet 2 by suitable printing processes or application processes. The whole is then heated to a temperature of from 30° to 80° C. to dry it and to react polyvinyl butyral with isocyanate, thereby forming a heat-resistant protective film.

In preparing the ink composition for forming the heat-resistant protective layer, it is preferable that a filler be previously admixed with the alkali metal or alkaline earth metal salt of phosphoric ester to prepare a filler-containing composition.

The heat-resistant protective layer 4 has preferably a film thickness of from 0.5 to 5 micrometers, more preferably from 1 to 2 micrometers. If the film thickness is less than 0.5 micrometer, the heat-resistant protective layer has not good properties. If the film thickness is more than 5 micrometers, the heat transmission from the thermal head to the sublimation transfer sheet becomes inferior and the printing density is reduced.

It is preferable to heat in order to accelerate the reaction of polyvinyl butyral and isocyanate. In order to prevent heat from affecting the heat transfer layer during heating, it is preferable that the order of providing the heat transfer layer 3 and the heat-resistant protective layer 4 on the base sheet 2 is as follows: the heat-resistant protective layer 4 is provided on one surface of the base sheet 2 and thereafter the heat transfer layer 3 is provided on the other surface of the base sheet 2.

While the fundamental structure of the heat transfer sheet according to the present invention is as described above, the following additional treatments may be carried out. A primer layer having a thickness of no more than 1 micron may be interposed between the heat transfer layer 3 and the base sheet 2, or between the heat-resistant protective layer 4 and the base sheet 2 in order to improve the bonding strength of respective layers. Known primers can be used in the present invention. When the primer layer is formed from acrylic resin, polyester resin and polyol/diisocyanate and a polyester resin is used as the material for the base sheet 2, the adhesion of both layers is particularly improved.

In addition to the optional primer layer described above, a heat-resistant layer can be interposed between the base sheet and the heat-resistant protective layer. This heat-resistant layer is obtained by curing with a curing agent a synthetic resin capable of curing during heating.

The heat-resistant layer and the heat-resistant protective layer prevent the sticking onto the thermal head and ensure smooth running.

A variety of combinations of a synthetic resin capable of curing during heating and a binder therefor can be used to form the heat-resistant layer. Representative combinations are polyvinyl butyral/polyhydric isocyanate, acryl polyol/polyhydric isocyanate, cellulose acetate/titanium chelating agent and polyester/organic titanium compound. Commercially available synthetic resins, commercially available curing agents, their trade names and their amounts to be incorporated (parts by weight) are shown in the following Tables.

Synthetic resins Nos. 1,2,3, . . . in Table 1 are used in combination with curing agents Nos. 1,2,3, . . . in Table 2, respectively.

TABLE 1

| No. | Synthetic Resins Capable of Curing During Heating | Amount (parts by weight) |
|---|---|---|
| 1 | Polyvinyl butyral "Eslec BX-1" (Sekisui Kagaku, Japan) | 100 |
| 2 | Urethane polyol "DF30-55" (Dai Nippon Ink, Japan) | 100 |
| 3 | Urethane polyol (1% of Co is added to "DF30-55") | 100 |
| 4 | Acryl polyol "Acryl Deck A-801P" (Dai Nippon Ink, Japan) | 100 |
| 5 | Polyester "Vylon 200" (Toyobo, Japan) | 100 |
| 6 | Polyester "Vylon 200" | 100 |
| 7 | Polyester "Vylon 200" | 100 |
| 8 | Polyester "Vylon 200" | 100 |
| 9 | Cellulose acetate "L20" | 100 |

TABLE 1-continued

| No. | Synthetic Resins Capable of Curing During Heating | Amount (parts by weight) |
|---|---|---|
| | (Hercules Incorporated) | |
| 10 | Cellulose acetate "L20" | 100 |
| 11 | Nitrocellulose "Nitcello SS74" (Daisel, Japan) | 20–50 |
| 12 | Chlorinated rubber "CR10" (Asahi Denka, Japan) | 100 |
| 13 | Chlorinated rubber "CR-10" | 100 |
| 14 | Melamine "Melan 45" (Hitachi Kasei, Japan) | 100 |

TABLE 2

| No. | Curing Agents | Amount (parts by weight) |
|---|---|---|
| 1 | Diisocyanate "Takenate D110N" (Takeda Yakuhin, Japan) | 45 |
| 2 | Polyisocyanate "Barnock D-750" (Dai Nippon Ink, Japan) | 20 |
| 3 | Polyisocyanate "Barnock D-750" | 20 |
| 4 | Polyisocyanate "Barnock D-750" | 20 |
| 5 | Polyisocyanate "Barnock D-750" | 20 |
| 6 | Titanium chelating agent "Tita Bond 50" (Nippon Soda, Japan) | 5–10 |
| 7 | Organic titanium compound "A-10" (Nippon Soda, Japan) | 10 |
| 8 | Organic titanium compound "B-10" (Nippon Soda, Japan) | 10 |
| 9 | Titanium chelating agent "Tita Bond 5D" (Nippon Soda, Japan) | 5 |
| 10 | Polyisocyanate "Barnock D-750" (Dai Nippon Ink, Japan) | 10 |
| 11 | Polyisocyanate "Barnock D-750" | 50–20 |
| 12 | Polyisocyanate "Barnock D-750" | 30 |
| 13 | Organic titanium compound "B-10" | 10 |
| 14 | Para-toluenesulfonic acid | 20 |

A filler is preferably incorporated in the synthetic resin described above. Examples of the fillers suitable for this purpose are magnesium carbonate, calcium carbonate, silica, clays, titanium dioxide and zinc oxide. The amount of the filler used is usually from 5 to 40% of the resin on a weight basis. In corporation is carried out in a three-roll mill or sand mill to provide sufficient dispersion.

If the adhesion of the heat-resistant layer to the base sheet is insufficient, it is preferable to use the suitable primer as described above.

In the heat transfer sheet according to the present invention, the heat-resistant layer mainly comprising (a) polyvinyl butyral, (b) isocyanate and (c) phosphoric esters, its alkali metal or alkaline earth metal salts is provided on a surface of the base sheet, i.e., surface contacting with the thermal head. Accordingly, the heat transfer sheet according to the present invention has the following effects and advantages.

(a) Even if the heat transfer sheet is heated to considerably high temperatures by means of the thermal head, no sticking phenomenon occurs and the thermal head can run.

(b) Surface roughness does not occur at printing areas.

(c) Even if heat printing is continuously carried out by means of the thermal head, the ingredients for the heat-resistant protective layer do not adhere to the thermal head.

While the present invention will be described by Examples hereinafter, the present invention is not limited thereto. Throughout these Examples quantities expressed in percent (%) and "parts" are by weight.

EXAMPLE 1

An ink composition for forming a heat-resistant protective layer comprising the following ingredients was prepared. The ink composition was applied onto a polyethylene terephthalate film (manufactured by Toyobo, Japan and marketed under the trade name "S-PET") having a thickness of 9 micrometers by a Mayer's bar #16 and dried by warm air. A heat curing treatment was carried out for 20 hours in a 60° C. oven. The coating weight (on a dry basis) was about 1.8 grams per square meter.

| Ink Composition for forming Heat-resistant Protective Layer | Parts |
|---|---|
| Polyvinyl butyral (manufactured by Sekisui Kagaku, Japan, and marketed under the trade name "Eslec BX-1") | 4.5 |
| Toluene | 45 |
| Methyl ethyl ketone | 45.5 |
| Phosphoric ester (manufactured by Daiichi Kogyo Seiyaku, Japan, and marketed under the trade name "Plysurf A-208S") | 0.45 |
| Diisocyanate (manufactured by Takeda Yakuhin, Japan, and marketed under the trade name "Takenate D-110N"; 75% ethyl acetate solution) | 2.0 |

An ink composition for forming a sublimation transfer layer comprising the following ingredients was then prepared. The ink composition was applied onto a surface opposite to the heat-resistant protective layer by a Mayer's bar #10 and dried by warm air. The coating weight of this heat transfer layer was about 1.2 grams per square meter.

| Ink Composition for forming Heat Sensitive Sublimation Transfer Layer | Parts |
|---|---|
| Disperse dye (manufactured by Nippon Kayaku, Japan, and marketed under the trade name "Kayaset Blue 714") | 4 |
| Polyvinyl butyral (manufactured by Sekisui Kagaku, Japan, and marketed under the trade name "Eslec BX-1") | 4.3 |
| Toluene | 40 |
| Methyl ethyl ketone | 40 |
| Isobutanol | 10 |

A synthetic paper having a thickness of 150 micrometers (manufactured by Ohji Yuka, Japan, and marketed under the trade name "YUPO-FPG150") was used as a base. An ink composition for forming an image-receptive layer comprising the following ingredients was applied onto the base by a Mayer's bar #36 to a coating weight of 4.0 grams per square meter (on a dry basis) thereby to produce a heat transferable sheet.

| Ink Composition for forming Image-receptive Layer | Parts |
|---|---|
| Vylon 103 (polyester resin, manufactured by Toyobo, Japan) | 8 |
| Elvaloy 741P (EVA polymer plasticizer, | 2 |

-continued

| Ink Composition for forming Image-receptive Layer | Parts |
|---|---|
| manufactured by Mitsui Polychemical, Japan) | |
| Amino-modified silicone oil (manufactured by Sin-etsu Silicone, Japan, and marketed under the trade name "KF-393") | 0.125 |
| Epoxy-modified silicone oil (manufactured by Sin-etsu Silicone, Japan, and marketed under the trade name "X-22-343") | 0.125 |
| Toluene | 70 |
| Methyl ethyl ketone | 10 |
| Cyclohexanone | 20 |

The heat sensitive sublimation transfer sheet and the heat transferable sheet obtained as described above were laminated so that the heat transfer layer and the image-receptive layer were in mutual contact. When recording was carried out from the side of the heat-resistant protective layer by means of a thermal head under the conditions of an output of 1 W/dot, a pulse width of from 0.3 to 4.5 milliseconds and a dot density of 3 dots/mm, no sticking phenomenon occurred and no wrinkles were generated. The heat transfer sheet smoothly ran. The reflection density of a highly developed color density portion at a pulse width of 4.5 milliseconds was 1.65, and the reflection density of a portion at a pulse width of 0.3 milliseconds was 0.16. Thus, a recording having gradation in accordance with the applied energy was obtained (as measured by a Macbeth densitometer RD-198).

EXAMPLE 2

Recording was carried out in the same manner as described in Example 1 except that the ink composition for forming the heat-resistant protective layer was replaced by the following composition.

| | Parts |
|---|---|
| Polyvinyl butyral (manufactured by Sekisui Kagaku, Japan, and marketed under the trade name "Eslec BX-1") | 4.5 |
| Toluene | 45.0 |
| Methyl ethyl ketone | 45.5 |
| Phosphoric ester (manufactured by Daiichi Kogyo, Japan, and marketed under the trade name "Plysurf A-20GS") | 0.45 |
| Diisocyanate (manufactured by Takeda Yakuhin, Japan, and marketed under the trade name "Coronate L"; 45% ethyl acetate solution) | 4.0 |

In this example, the generation of sticking phenomenon and wrinkles was not observed. Solid areas did not exhibit surface roughness and it was possible to carry out printing.

EXAMPLE 3

An ink composition for forming a heat-resistant protective layer, of Example 1 was replaced by an ink composition comprising the following ingredients:

| | Parts |
|---|---|
| Polyvinyl butyral (manufactured by Denki Kagaku, Japan, and marketed under the trade name "Denka Butyral #6000-C") | 4.5 |
| Toluene | 45.0 |
| Methyl ethyl ketone | 45.5 |
| Phosphoric ester (manufactured by Tohho Kagaku, Japan, and marketed under the trade name "GAFAC RA-600") | 0.45 |
| Diisocyanate (manufactured by Takeda Yakuhin, Japan, and marketed under the trade name "Coronate L"; 45% ethyl acetate solution) | 4.0 |

The following ingredients were pulverized for 24 hours in a ball mill to prepare an ink composition for forming a heat sensitive sublimation transfer layer. The ink composition was then applied onto a base sheet by a Mayer's bar #14 to a coating weight of 1.6 grams per square meter (on a dry basis).

| | Parts |
|---|---|
| Disperse dye (manufactured by Nippon Kayaku, Japan, and marketed under the trade name "Kayaset Blue 136") | 6 |
| Ethyl cellulose | 5 |
| Toluene | 40 |
| Methyl ethyl ketone | 40 |
| Isopropyl alcohol | 10 |

The heat sensitive sublimation transfer sheet and the heat transferable sheet thus obtained were used to carry out printing by means of a thermal head under the same conditions as described in Example 1. In this heat transfer sheet, neither sticking phenomenon nor wrinkles were generated. The printing density of a portion at a pulse width of 4.5 milliseconds was 1.48, and the printing density of a portion at a pulse width of 0.3 millisecond was 0.11. Thus, a recording having gradation was obtained.

COMPARATIVE EXAMPLE 1

Recording was carried out in the same manner as described Example 1 except that the ink composition for forming the heat-resistant protective layer was replaced by the following composition. When the printing test was carried out by means of a thermal head, it was possible to carry out running. However, the solid printing areas exhibited surface roughness, and the printed matter having a good printing image could not be obtained.

| | Parts |
|---|---|
| Polyvinyl butyral (manufactured by Sekisui Kagaku, Japan, and marketed under the trade name "Eslec BX-1") | 4.5 |
| Toluene | 40 |
| Methyl ethyl ketone | 50 |
| Talc | 0.8 |
| Diisocyanate (manufactured by Takeda Yakuhin, Japan, and marketed under the trade name "Takenate D-110N"; 75% ethyl acetate solution) | 2.0 |

COMPARATIVE EXAMPLE 2

Recording was carried out in the same manner as described in Example 1 except that the ink composition for forming the heat-resistant protective layer was replaced by the following composition.

| | Parts |
|---|---|
| Polyvinyl butyral (manufactured by Sekisui Kagaku, Japan, and marketed under the trade name "Eslec BX-1") | 4.5 |
| Toluene | 40 |
| Methyl ethyl ketone | 40 |
| Silicone KP 358 (available from Sin-etsu Silicone, Japan) | 0.6 |
| Diisocyanate (manufactured by Takeda Yakuhin, Japan, and marketed under the trade name "Takenate D-110N"; 75% ethyl acetate solution) | 2.0 |

When the heat sensitive sublimation transfer sheet having this heat-resistant protective layer was used to carry out printing under the same conditions as described in Example 1 by means of a thermal head, printing and running could be carried out without any problem. However, if the heat transfer sheet is in such a state that this heat-resistant protective layer is brought into contact with the heat transfer layer, i.e., the heat transfer sheet was in a form of roll in a printer, dye bleeding occurred at the surface of the heat transfer layer. If the heat transfer sheet exhibiting such a state is used to carry out printing, scumming was generated.

EXAMPLE 4

A heat-resistant protective layer was provided on one surface of a polyethylene terephthalate film having a thickness of 9 micrometers in the same manner as described in Example 1. A heat-fusing transfer layer was provided on a surface opposite to the aforementioned surface of the polyethylene terephthalate film, as described hereinafter.

Tolylene-2,6-diisocyanate and ethyl cellosolve were first mixed so that the molar ratio of —NCO to —OH present in respective molecules was 1:1. Dibutyltin laurate was charged into the thus obtained mixture as a catalyst in an amount of 0.01% of the total amount of the mixture. The resulting mixture was continuously stirred for 5 hours while maintaining the temperature at 100° C. thereby to prepare a base composition A.

The thus obtained base composition A was mixed with the following ingredients to prepare a composition for forming a heat-fusing transfer layer comprising the following ingredients:

| Composition for forming Heat-fusing Transfer Layer | % |
|---|---|
| Base composition A | 50 |
| Toluene | 36 |
| Carbon black | 10 |
| Softening agent (manufactured by Idemitsu Sekiyu, Japan, and marketed under the trade name "CS-55") | 2 |
| Polyethylene glycol having an average molecular weight of 4,000 | 2 |

This composition for forming the heat-fusing transfer layer was applied onto the foregoing surface of the polyethylene terephthalate film by the wire bar coating process while heating the film to 170° C. to a thickness of 2 micrometers, thereby to form a heat-fusing transfer layer. Thus, a heat transfer sheet was produced.

This heat transfer sheet and a wood-free paper having a basis weight of 50 grams per square mater were laminated. When printing was carried out by means of a thermal printer (SP-3080 available from Shinko Denki, Japan), sticking did not occur. A black sharp printing image was formed on the surface of the wood-free paper.

EXAMPLE 5

The heat sensitive sublimation transfer sheet and the heat transferable sheet were prepared according to Example 1 except that an ink composition for forming a heat-resistant protective layer was prepared and used to form a heat-resistant protective layer, as described hereinafter.

An ink composition for forming a heat-resistant protective layer comprising following ingredients was prepared, then applied onto a polyethylene terephthalate film (manufactured by Toyobo, Japan and marketed under the trade name "S-PET") having a thickness of 9 micrometers by a Mayer's bar #16 and dried by warm air. A heat curing treatment was carried out for 48 hours in a 60° C. oven. The coating weight (on a dry basis) was about 1.8 grams per square meter.

| Ink Composition for forming Heat-resistant Protective Layer | Parts |
|---|---|
| Polyvinyl butyral (manufactured by Sekisui Kagaku, Japan, and marketed under the trade name "Eslec BX-1" | 4.5 |
| Toluene | 45 |
| Methyl ethyl ketone | 45.5 |
| Sodium salt of phosphoric ester (sodium salt of aliphatic phosphoric ester, manufactured by Tohho Kagaku, Japan, and marketed under the trade name "GAFAC RD-720") | 1.35 |
| Diisocyanate (manufactured by Nippon Polyurethane, Japan, and marketed under the trade name "Coronate L"; 75% ethyl acetate solution) | 1.8 |
| Amine catalyst (manufactured by Nippon Polyurethane, Japan, and marketed under the trade name "NY 3"; 10% ethylene dichloride-ethyl acetate solution) | 0.23 |

The heat sensitive sublimation transfer sheet and the heat transferable sheet thus obtained were laminated so that the heat transfer layer and the image-receptive layer were in mutual contact. When recording was carried out from the side of the heat-resistant protective layer by means of a thermal head under the conditions of an output of 1 W/dot, a pulse width of from 0.3 to 4.5 milliseconds and a dot density of 3 dots/mm, no sticking phenomenon occurred and no wrinkles were generated. The heat transfer sheet smoothly ran. The reflection density of a highly developed color density portion at a pulse width of 4.5 milliseconds was 1.65, and the reflection density of a portion at a pulse width of 0.3 millisecond was 0.16. Thus, a recording having gradation in accordance with the applied energy was obtained (as measured by a Macbeth densitometer RD-918).

When the resulting heat transfer sheet was wound around a paper tube to cause the heat transfer layer to come in intimate contact with the heat-resistant protective layer and then an aging acceleration test was carried out for 14 days in a 50° C. oven, the contamination of the heat-resistant protective layer due to the migration of the dye present in the heat transfer layer and the contamination of the heat transfer layer due to the migration of the surfactant present in the heat-resistant protective layer were not observed.

COMPARATIVE EXAMPLE 3

Recording was carried out in the same manner as described in Example 5 except that the ink composition for forming the heat-resistant protective layer was replaced by the following composition.

| | Parts |
|---|---|
| Polyvinyl butyral (manufactured by Denki Kagaku, Japan, and marketed under the trade name "Denka Butyral 5000A") | 4.5 |
| Toluene | 45 |
| Methyl ethyl ketone | 45 |
| Phosphoric ester (aliphatic phosphoric ester, manufactured by Tohho Kagaku, Japan, and marketed under the trade name "GAFAC RS-710") | 1.35 |
| Diisocyanate (manufactured by Nippon Polyurethane, Japan, marketed under the trade name "Coronate L"; 75% ethyl acetate solution) | 1.8 |
| Amine catalyst (manufactured by Nippon Polyurethane, Japan, and marketed under the trade name "NY 3"; 10% ethylene dichloride-ethyl acetate solution) | 0.23 |

In this example, the generation of sticking phenomenon and wrinkles was not observed, and the solid areas did not exhibit surface roughness. It was possible to carry out printing.

However, when the resulting heat transfer sheet was wound around a paper tube to cause the heat transfer layer to come in intimate contact with the heat-resistant protective layer and then an aging acceleration test was carried out for 14 days in a 50° C. oven, the dye present in the heat transfer layer migrated to the heat-resistant protective layer to cause it to form color. Further, unevenness of the dye density due to the dye removal from the heat transfer layer occurred. When such a heat transfer sheet was used to carry out printing, the disturbance of an image and scumming were generated.

EXAMPLE 6

The heat sensitive sublimation transfer sheet and the heat transferable sheet were prepared according to Example 1 except that an ink composition for forming a heat-resistant protective layer was prepared and used to form a heat-resistant protective layer, as described hereinafter.

Forty parts of calcium carbonate (manufactured by Shiraishi Calcium, Japan, and marketed under the trade name "Hakuenka DD") and 60 parts of sodium salt of phosphoric acid (manufactured by Tohho Kagaku, Japan, and marketed under the trade name "GAFAC RD 720") were thoroughly kneaded in a three-roll mill to prepare a filler-containing composition. This was mixed with the following ingredients to prepare an ink composition for forming a heat-resistant protective layer. The resulting ink composition for forming the heat-resistant protective layer was applied onto a polyethylene terephthalate film having a thickness of 9 micrometers (manufactured by Toyobo, Japan, and marketed under the trade name "S-PET") by Mayer's bar #16 and dried by warm air. A heat curing treatment was then carried out for 48 hours in a 60° C. oven. The coating weight (on a dry basis) was about 1.8 grams per square meter.

| Ink Composition for forming Heat-resistant Protective Layer | Parts |
|---|---|
| Polyvinyl butyral (manufactured by Sekisui Kagaku, Japan, and marketed under the trade name "Eslec BX-1") | 6 |
| Toluene | 47 |
| Methyl ethyl ketone | 47 |
| Filler-containing composition described above | 1.2 |
| Phosphoric ester which is not in a salt form (manufactured by Daiichi Kogyo Seiyaku, Japan, and marketed under the trade name "Plysurf A208S") | 1.2 |
| Diisocyanate (manufactured by Nippon Polyurethane, Japan, and marketed under the trade name "Coronate L"; 75% ethyl acetate solution) | 2.4 |
| Amine catalyst (manufactured by Nippon Polyurethane, Japan, and marketed under the trade name "NY 3"; 10% ethylene dichloride-ethyl acetate solution) | 0.3 |

The heat sensitive sublimation transfer sheet and the heat transferable sheet thus obtained were laminated so that the heat transfer layer and the image-receptive layer were in mutual contact. When recording was carried out from the side of the heat-resistant protective layer by means of a thermal head under the conditions of an output of 1 W/dot, a pulse width of from 0.3 to 4.5 milliseconds and a dot density of 3 dots/mm, no sticking phenomenon occurred and no wrinkles were generated. The heat transfer sheet smoothly ran. The reflection density of a highly developed color density portion at a pulse width of 4.5 milliseconds was 1.65, and the reflection density of a portion at a pulse width of 0.3 millisecond was 0.16. Thus, a recording having gradation in accordance with the applied energy was obtained (as measured by a Macbeth densitometer RD-918).

When the heat transfer sheet was wound around a paper tube to cause the heat transfer layer to come into intimate contact with the heat-resistant protective layer and then an ageing acceleration test was carried out for 14 days in a 50° C. oven, the contamination of the heat-resistant protective layer due to the migration of the dye present in the heat transfer layer and the contamination of the heat transfer layer due to the migration of the surfactant present in the heat-resistant protective layer were not observed.

When the heat transfer sheet was traveled by means of a transfer roll, the generation of wrinkles due to the adhesion between the heat transfer sheet and the roll was not observed.

EXAMPLE 7

Recording was carried out in the same manner as described in Example 6 except that calcium carbonate present in the filler-containing composition was replaced by talc (manufactured by Nippon Talc, Japan, and marketed under the trade name "Micro-ace L-1").

In this example, the generation of sticking phenomenon and wrinkles was not observed. When an ageing acceleration test was carried out in the same manner as described in Example 6, no contamination was observed as in Example 6.

EXAMPLE 8

A heat transfer sheet was produced and recording was carried out in the same manner as described in Example 6 except that calcium carbonate present in the filler-containing composition was replaced by clay (manufactured by Tsuchiya Kaolin, Japan, and marketed under the trade name "ASP 170"). The generation of sticking phenomenon and wrinkles was not observed. When an ageing acceleration test was carried out in the same manner as described in Example 6, no contamination was observed as in Example 1.

COMPARATIVE EXAMPLE 4

A heat transfer sheet was produced and recording was carried out in the same manner as described in Example 8 except that sodium salt of phosphoric ester compound (manufactured by Tohho Kagaku, Japan, and marketed under the trade name "GAFAC RD 720") present in the filler-containing composition was replaced by phosphoric ester which was not in a salt form (manufactured by Tohho Kagaku, Japan, and marketed under the trade name "GAFAC RS710"). The generation of sticking phenomenon and wrinkles was not observed. However, when an ageing acceleration test was carried out in the same manner as described in Example 6, the dye present in the heat transfer layer migrated to the heat-resistant protective layer to cause the heat-resistant protective layer to form color and to occur unevenness of the dye density due to the dye removal from the heat transfer layer. When such a heat transfer sheet was used to carry out printing, the disturbance of an image and scumming were generated.

EXAMPLE 9

A heat transfer sheet was produced and recording was carried out in the same manner as described in Example 6 except that phosphoric ester (Plysurf A208S) which was not in a salt form was not incorporated in an ink composition for forming a heat-resistant protective layer. The results substantially similar to those of Example 6 were obtained.

EXAMPLE 10

The heat sensitive sublimation transfer sheet and the heat transferable sheet were prepared according to Example 1 except that the following ink composition for forming a heat-resistant layer was first applied onto a base sheet to form a heat-resistant layer between the base sheet and a heat-resistant protective layer and Kayaset Blue 136 was used instead of Kayaset Blue 714 as disperse dye. An ink composition I for forming a heat-resistant layer comprising the following ingredients was prepared. This ink composition was applied onto a polyethylene terephthalate film having a thickness of 9 micrometers (base sheet manufactured by Toyobo, Japan and marketed under the trade name "S-PET") by a Mayer's bar #8 and dried by warm air.

| Ink Composition I for forming Heat-resistant Layer | Parts |
|---|---|
| Polyvinyl butyral resin "Eslec BX-1" (available from Sekisui Kagaku, Japan) | 4.5 |
| Toluene | 45 |
| Methyl ethyl ketone | 45.5 |
| Diisocyanate "Takenate D-110N" (available from Takeda Yakuhin, Japan; 75% ethyl acetate solution) | 2.0 |

The heat sensitive sublimation transfer sheet and the heat transferable sheet thus obtained were laminated so that the heat transfer layer and the image-receptive layer were in mutual contact. Recording were carried out from the side of the heat-resistant layer by a thermal head. The recording conditions were an output of 1 W/dot, a pulse width of from 0.3 to 4.5 milliseconds, and a dot density of 3 dots/mm.

No sticking phenomenon occurred, and no wrinkles were generated. The heat transfer sheet smoothly ran. When the printing density was measured by a "Macbath densitormer RD-918", the reflection density of a highly developed color density portion at a pulse width of 4.5 milliseconds was 1.65 and the reflection density of a portion at a pulse width of 0.3 millisecond was 0.16. Thus, a recording having gradation in accordance with the applied energy was obtained.

EXAMPLE 11

Ink compositions were applied onto a polyester base sheet in the same manner as described in Example 10 except that the following ink composition for forming a heat-resistant layer and the ink composition for forming the heat-resistant protective layer of Example 2 (GAFAC RD720 instead of GAFC RA600 as phosphoric ester) were used.

| Ink Composition II for forming Heat-resistant Layer | Parts |
|---|---|
| Polyvinyl butyral resin "Eslec BX-1" | 4.5 |
| Toluene | 45.0 |
| Methyl ethyl ketone | 45.5 |
| Diisocyanate "Coronate L" (available from Nippon Polyurethane, Japan; 45% ethyl acetate solution) | 4.0 |

The base sheet provided with the heat-resistant layer and the heat-resistant protective layer was heated and cured in the same manner as described in Example 10. Thereafter, a heat sensitive sublimation transfer layer was formed thereon. The resulting heat transfer sheet and the heat transferable sheet used in Example 10 were laminated, and printing was carried out in the same conditions as described in Example 10.

In this example, the generation of sticking phenomenon and wrinkles was not observed, and the solid areas did not exhibit surface roughness. Good printing could be carried out.

EXAMPLE 12

A heat transfer sheet was produced in the same manner as described in Example 10 except that the following ink composition for forming a heat-resistant layer and the ink composition for forming the heat-resistant protective layer of Example 3 were used.

| Ink Composition III for forming Heat-resistant Layer | Parts |
|---|---|
| Polyvinyl butyral "Denka Butyral #6000-C" (available from Denki Kagaku, Japan) | 4.5 |
| Toluene | 45.0 |
| Methyl ethyl ketone | 45.5 |
| Diisocyanate "Coronate L" (45% ethyl acetate solution) | 4.0 |

When printing was carried out in the same manner as described in Example 10, the generation of sticking phenomenon and wrinkles was not observed, and the solid areas did not exhibit surface roughness.

EXAMPLE 13

The ink composition for forming the heat-resistant protective layer of Example 6 (without amine catalyst) was applied onto the heat-resistant layer of ink composition I which was provided on the base sheet as described in Example 10. The whole was heated for 12 hours in an oven at a temperature of 60° C. to cure. When printing was carried out in the same manner as described in Example 10, sticking did not occur and the solid areas did not exhibit surface roughness.

EXAMPLE 14

A heat-resistant layer was provided on one surface of a polyethylene terephthalate film having a thickness of 9 micrometers in the same manner described in Example 10. An ink composition for forming a heat sensitive fusing transfer layer obtained by Example 4 was applied onto the opposite surface of the film by the wire bar coating process while heating to 170° C. to a thickness of 2 micrometers. Thus, a heat transfer sheet was produced.

This heat transfer sheet and a wood-free paper having a basis weight of 50 grams per square meter were laminated. When printing was carried out by means of a thermal printer (SP-3080 available from Shinko Denki, Japan), sticking did not occur. A blank sharp printing image was formed on the surface of the wood-free paper.

EXAMPLE 15

An ink composition for forming a heat-resistant layer comprising the following ingredients was prepared. The ink composition was applied onto a polyethylene terephthalate film (manufactured by Toyobo, Japan and marketed under the trade name "S-PET") having a thickness of 9 micrometers by a Mayer's bar #8 and dried by warm air.

| Ink Composition for forming Heat-resistant Layer | Parts |
|---|---|
| Acryl polyol (manufactured by Taisei Kako, Japan, and marketed | 67 |

-continued

| Ink Composition for forming Heat-resistant Layer | Parts |
|---|---|
| under the trade name "ACRIT6416MA"; 45% toluene-ethyl acetate solution) | |
| Toluene | 50 |
| Methyl ethyl ketone | 50 |
| Sand-mill dispersion* | 14 |
| Diisocyanate (manufactured by Nippon Polyurethane, Japan and marketed under the trade name "Coronate L"; 75% ethyl acetate solution) | 7.2 |
| Acryl polyol (same as the above) | 50 |
| Talc (manufactured by Nippon Talc, Japan, and marketed under the trade name "Micro-ace L-1) | 35 |
| Cyclohexane | 10 |

*Sand-mill dispersion used herein has the following ingredients.

Further, 40 parts of talc abovementioned and 60 parts of sodium salt of phosphoric acid (marketed under the trade name "GAFAC PA 720 from Tohho Kagaku, Japan) were thoroughly kneaded in a three-roll mill to prepare a dispersion composition, which was used in the composition shown below.

| Ink composition for forming Heat-resistant Protective Layer | Parts |
|---|---|
| Polyvinyl butyral (marketed under the trade name "Eslec BX-1, from Sekisui Kagaku, Japan) | 6 |
| Toluene | 47 |
| Methyl ethyl ketone | 47 |
| Dispersion composition described above | 2.25 |
| Phosphoric acid ester (marketed under the name of "Plysurf A 208S" from Sekisui Kagaku) | 1.2 |
| Toluene-diisocyanate adduct (marketed under the name of "coronate L" from Nippon Polyurethane, Japan; 75% ethylacetate solution) | 2.4 |

A heat curing treatment was carried out for 12 hours in a 60° C. The coating weight (on a dry base) was about 1.2 g/m$^2$.

An ink composition for forming a sublimation transfer layer comprising the following ingredients was then prepared. The ink composition was applied onto a surface opposite to the heat-resistant protective layer by a Mayer's bar #10 and dried by warm air. The coating weight of this heat transfer layer was about 1.2 grams per square meter. A heat-transfer sheet was thus obtained.

| Ink Composition for forming Heat Sensitive Sublimation Transfer Layer | Parts |
|---|---|
| Disperse dye (manufactured by Nippon Kayaku, Japan, and marketed under the trade name "Kayaset Blue 136") | 4 |
| Polyvinyl butyral (manufactured by Sekisui Kagaku, Japan, and marketed under the trade name "Eslec BX-1") | 4.3 |
| Toluene | 40 |
| Methyl ethyl ketone | 40 |

-continued

| Ink Composition for forming Heat Sensitive Sublimation Transfer Layer | Parts |
|---|---|
| Isobutanol | 10 |

A synthetic paper having a thickness of 150 micrometers (manufactured by Ohji Yuka, Japan, and marketed under the trade name "YUPO-FPG150") was used as a base. An ink composition for forming an image-receptive layer comprising the following ingredients was applied onto the base by Mayer's bar #36 to a coating weight of 4.0 grams per square meter (on a dry basis) thereby to produce a heat transferable sheet.

| Ink Composition for forming Image-receptive Layer | Parts |
|---|---|
| Vylon 103 (polyester resin, manufactured by Toyobo, Japan) | 8 |
| Elvaloy 741P (EVA polymer plasticizer, manufactured by Mitsui Polychemical, Japan) | 2 |
| Amino-modified silicone oil (manufactured by Sin-etsu Silicone, Japan, and marketed under the trade name "KF-393") | 0.125 |
| Epoxy-modified silicone oil (manufactured by Sin-etsu Silicone, Japan, and marketed under the trade name "X-22-343") | 0.125 |
| Toluene | 70 |
| Methyl ethyl ketone | 10 |
| Cyclohexanone | 20 |

The heat sensitive sublimation transfer sheet and the heat transferable sheet obtained as described above were laminated so that the heat transfer layer and the image-receptive layer were in mutual contact.

Recording was carried out from the side of the heat-resistant protective layer by means of a thermal head under the conditions of an output of 1 W/dot, a pulse width of from 0.3 to 4.5 milliseconds and a dot density of 3 dots/mm.

No sticking phenomenon occurred and no wrinkles were generated. The heat transfer sheet smoothly ran. The reflection density of a highly developed color density portion at a pulse width of 4.5 milliseconds was 1.65, and the reflection density of a portion at a pulse width of 0.3 millisecond was 0.16. Thus, a recording having gradation in accordance with the applied energy was obtained (as measured by a Macbeth densitometer RD-918).

EXAMPLE 16

Preparation of the heat transfer sheet and the heat transferable sheet and recording were carried out in the same manner as described in Example 15 except for 1.2 parts of phosphoric ester "Plysurf A 208" in ink composition for forming heat-resistant protective layer was replaced by 0.3 parts of lecitin (manufactured by Ajinomoto Co. Japan).

In this example, the generation of sticking phenomenon was not observed and solid areas did not exhibit surface roughness.

What is claimed is:

1. A heat transfer sheet comprising a heat transfer layer provided on one surface of a base sheet, and a heat-resistant protective layer provided on the other surface of said base sheet, said heat-resistant protective layer containing (a) polyvinyl butyral, (b) an isocyanate, and (c) a compound selected from the group consisting of phosphoric esters, its alkali metal and alkalie earth metal salts, and mixtures thereof.

2. The heat transfer sheet according to claim 1 wherein said heat-resistant protective layer further contains a filler.

3. The heat transfer sheet according to claim 2 wherein said filler is selected from the group consisting of calcium carbonate, talc, aluminosilicates, clays, zeolites, Teflon powder, zinc oxide, magnesium oxide, titanium dioxide, silica, carbon, and the condensate of benzoguanamine and formaldehyde.

4. The heat transfer sheet according to claim 1 wherein said heat transfer layer is a heat sensitive sublimation transfer layer comprising a dye having heat transferability and a binder resin.

5. The heat transfer sheet according to claim 1 wherein said heat transfer layer is a heat sensitive fusing transfer layer wherein a dye or pigment is dispersed in a wax material.

6. The heat transfer sheet according to claim 1 wherein said alkali metal salt of phosphoric ester is a sodium salt of phosphoric ester.

7. The heat transfer sheet according to claim 1 which further comprises a heat-resistant layer interposed between said base sheet and said heat-resistant protective layer, said heat-resistant layer being obtained by curing with a curing agent a synthetic resin capable of curing upon being heated.

8. The heat transfer sheet according to claim 7 wherein the combination of said synthetic resin capable of curing upon being heated and said curing agent from which said heat-resistant layer is produced is selected from the group consisting of polyvinyl butyral/polyhydric isocyanates, acryl polyol/polyhydric isocyanates, cellulose acetate/titanium chelating agents, and polyester/organic titanium compounds.

9. The heat transfer sheet according to claim 7 wherein said heat-resistant layer and/or said heat-resistant protective layer contain a filler.

10. The heat transfer sheet according to claim 9 wherein said filler is selected from the group consisting of calcium carbonate, talc, aluminosilicates, clays, zeolites, Teflon powder, zinc oxide, magnesium oxide, titanium dioxide, silica, carbon, and the condensate of benzoguanamine and formaldehyde.

* * * * *